US008082712B1

(12) United States Patent
Butler et al.

(10) Patent No.: US 8,082,712 B1
(45) Date of Patent: Dec. 27, 2011

(54) VENTILATED DECK DRAINAGE SYSTEMS

(76) Inventors: David Lee Butler, Woodstock, GA (US); Anthony James Sclafani, Evergreen, CO (US)

( * ) Notice: Subject to any disclaimer, the term of this patent is extended or adjusted under 35 U.S.C. 154(b) by 37 days.

(21) Appl. No.: 11/604,479

(22) Filed: Nov. 27, 2006

Related U.S. Application Data

(60) Provisional application No. 60/749,653, filed on Dec. 12, 2005, provisional application No. 60/751,488, filed on Dec. 19, 2005.

(51) Int. Cl.

| | |
|---|---|
| ***E04B 1/70*** | (2006.01) |
| ***E04B 1/66*** | (2006.01) |
| ***E04B 7/00*** | (2006.01) |
| ***E04F 17/00*** | (2006.01) |
| ***E04D 13/00*** | (2006.01) |
| ***F24F 13/20*** | (2006.01) |

(52) U.S. Cl. ..... 52/302.1; 52/302.3; 52/302.6; 52/302.7; 52/11; 52/198; 454/367

(58) Field of Classification Search ..... 52/302.1, 52/302.3, 302.6, 302.7, 11, 12; 454/367
See application file for complete search history.

(56) References Cited

U.S. PATENT DOCUMENTS

| | | | | |
|---|---|---|---|---|
| 872,018 | A * | 11/1907 | Repp | 52/462 |
| 4,065,883 | A | 1/1978 | Thibodeau | |
| 4,446,805 | A | 5/1984 | Sugahara et al. | |
| 4,663,894 | A | 5/1987 | LaRoche et al. | |
| 4,697,399 | A | 10/1987 | Ryan | |
| 4,860,502 | A | 8/1989 | Mickelsen | |
| 5,511,351 | A | 4/1996 | Moore | |
| 5,605,022 | A | 2/1997 | Fulton | |
| 5,765,328 | A * | 6/1998 | Moore | 52/302.1 |
| 5,765,329 | A * | 6/1998 | Huang | 52/302.3 |
| 5,867,943 | A * | 2/1999 | Thomas | 52/11 |
| 6,164,019 | A | 12/2000 | Salley | |
| 6,226,941 | B1 | 5/2001 | Stevens | |
| 6,226,956 | B1 * | 5/2001 | Davis et al. | 52/745.06 |
| 6,240,690 | B1 | 6/2001 | James et al. | |
| 6,244,006 | B1 * | 6/2001 | Shue et al. | 52/302.1 |
| 6,260,316 | B1 | 7/2001 | Davis et al. | |
| 6,279,271 | B1 * | 8/2001 | Burkart, Jr. | 52/11 |
| 6,308,479 | B1 | 10/2001 | Prohofsky | |
| 6,343,450 | B1 | 2/2002 | Vance, Jr. | |
| 6,385,931 | B1 * | 5/2002 | Risser | 52/302.1 |
| 6,393,785 | B1 | 5/2002 | Burt | |
| 6,415,571 | B2 | 7/2002 | Risser | |
| 6,421,967 | B1 | 7/2002 | Wlaker | |
| 6,447,390 | B1 * | 9/2002 | O'Hagin | 454/250 |
| 6,688,059 | B1 | 2/2004 | Walker | |
| 6,694,686 | B2 | 2/2004 | Ready et al. | |
| 6,796,092 | B1 | 9/2004 | Goebel | |
| 6,886,302 | B2 | 5/2005 | Jackson | |
| 7,028,437 | B2 * | 4/2006 | Hauck | 52/302.1 |
| 7,234,281 | B2 * | 6/2007 | Hauck | 52/302.3 |

(Continued)

*Primary Examiner* — Brian Glessner
*Assistant Examiner* — Omar Hijaz
(74) *Attorney, Agent, or Firm* — Hope Baldauff Hartman, LLC

(57) ABSTRACT

A system and method for providing a deck drain vent system is disclosed. The deck drain vent system includes at least one panel disposed below a lower surface of a deck. The panel is substantially planar and has a bottom side and a top side facing and spaced apart from the lower surface. At least one vent penetrates the panel to allow fluid communication between the cavity and the bottom side. The deck drain vent system further includes a shaft lock secured to the vent. The shaft lock hinders liquids and debris from entering the vent, yet allows air to freely circulate between the cavity and a surrounding atmosphere.

16 Claims, 6 Drawing Sheets

U.S. PATENT DOCUMENTS

| | | | | |
|---|---|---|---|---|
| 7,424,790 | B2 * | 9/2008 | Austin et al. | 52/94 |
| 2001/0029706 | A1 | 10/2001 | Risser | |
| 2002/0032990 | A1 * | 3/2002 | Burkart, Jr. | 52/11 |
| 2003/0029096 | A1 | 2/2003 | Burkart, Jr. | |
| 2003/0074850 | A1 * | 4/2003 | Ready et al. | 52/302.1 |
| 2004/0020136 | A1 * | 2/2004 | Hauck | 52/11 |
| 2005/0217203 | A1 * | 10/2005 | Haddock | 52/782.1 |
| 2005/0252151 | A1 | 11/2005 | Kindred | |
| 2006/0162262 | A1 * | 7/2006 | Smith | 52/58 |
| 2007/0175106 | A1 * | 8/2007 | Rotter | 52/12 |

* cited by examiner

VENTILATED DECK DRAINAGE SYSTEMS

CROSS-REFERENCE TO RELATED APPLICATIONS

This application is related to U.S. Provisional Application having Ser. No. 60/749,653 filed on Dec. 12, 2005, which is incorporated herein by reference in its entirety. This application is further related to U.S. Provisional Application having Ser. No. 60/751,488 filed on Dec. 19, 2005, which is incorporated herein by reference in its entirety.

FIELD OF INVENTION

The present invention generally relates to deck drainage systems. More particularly, the present invention relates to a deck drainage system that includes a ventilation system for allowing gas to circulate between a cavity formed by the deck drainage system and the adjacent deck such that water vapor may escape and not collect within the cavity.

BACKGROUND OF THE INVENTION

There are a multitude of deck drainage systems designed to catch liquids and solids which pass through spacing of deck boards. All of these systems, however, do not allow air and gases to circulate between a cavity formed by the deck and the deck drainage systems. By not allowing gases to circulate, moisture collects within the cavity and enables mold, fungus, and bacteria to grow, as well as potentially leading to rotting of the deck structure.

There exists a need in the art for a deck drainage system that includes a venting system that enables gases to circulate between the cavity and ambient. In addition, the venting system should prevent liquids and solids from falling into the space beneath the deck or other elevated platform.

BRIEF SUMMARY OF THE INVENTION

Consistent with embodiments of the present invention, a deck drainage vent system is disclosed. The deck drainage vent system comprises at least one panel disposed below a lower surface of a deck. The panel is substantially planar and has a bottom side and an opposed top side that faces and is spaced apart from the deck's lower surface. The top side and the lower surface form a cavity between the panel and the deck. At least one vent penetrates the panel to allow fluid communication between the cavity and a surrounding atmosphere.

BRIEF DESCRIPTION OF THE FIGURES

Non-limiting and non-exhaustive embodiments are described with reference to the following figures, wherein like reference numerals refer to like parts throughout the various views unless otherwise specified.

DETAILED DESCRIPTION

Various embodiments are described more fully below with reference to the accompanying drawings, which form a part hereof, and which show specific embodiments for practicing the invention. However, embodiments may be implemented in many different forms and should not be construed as limited to the embodiments set forth herein; rather, these embodiments are provided so that this disclosure will be thorough and complete, and will fully convey the scope of the invention to those skilled in the art. Embodiments may be practiced as methods, systems or devices. Accordingly, the following detailed description is, therefore, not to be taken in a limiting sense.

Figure 1:
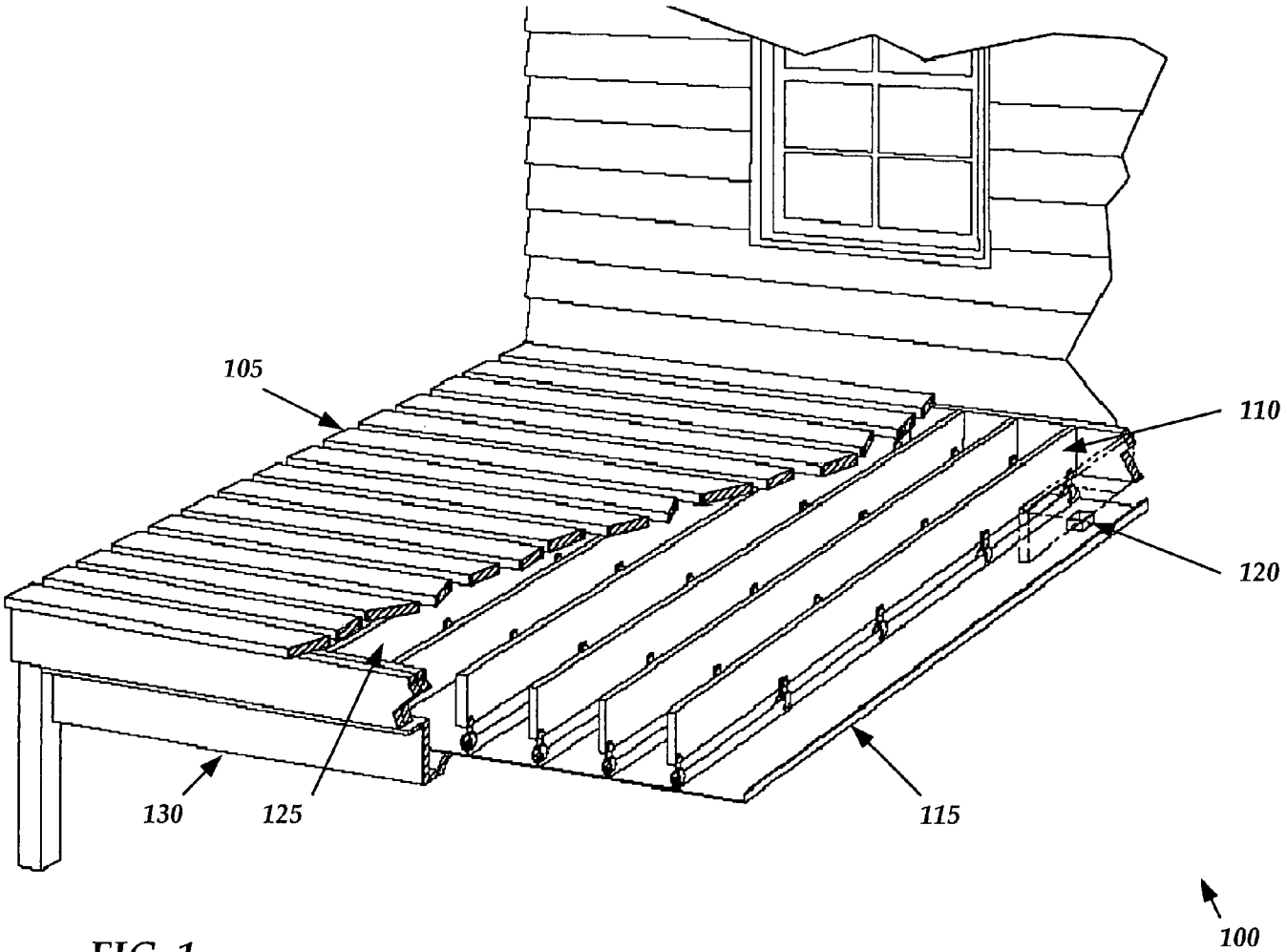
FIG. 1 depicts a deck drain vent system consistent with embodiments of the present invention.

Referring more particularly to the drawings, FIG. 1 depicts a deck drain vent system 100 consistent with embodiments of the present invention. The deck drain vent system 100 includes a deck 105 including a joist 110 and at least one panel 115 located beneath the deck 105. The panel 115 of the deck drain vent system 100 includes at least one vent 120. The vent 120 penetrates the panel 115 to allow fluid communication between a cavity 125 formed by the panel 115 and the deck 105. In addition, the panel 115 may include a pitch relative to horizontal such that liquids and solids (e.g., rainwater, leaves, pine straw, etc.) may be gravity fed to a gutter system 130. The gutter system 130 is configured to catch and divert liquids and solids which pass through spaces between deck boards of the deck 105 such that the cavity beneath the deck 105 remains substantially free of liquids and solids most of the time (i.e., after rain passes).

As stated above, cavity 125 is formed by panel 115 and deck 105. The dimensions of cavity 125 may vary depending upon a particular installation. Generally, panel 115 may be located below the deck surface at distances ranging from about six inches to about 18 inches. Panel 115 may be formed by extrusion or bending a material via standard sheet metal forming techniques. Panel 115 may alternatively be formed of various forms of plastic formations which may be made by injection molding or extrusion.

To avoid cluttering FIG. 1, only a single vent 120 proximate the structure is depicted; however, it is understood that the deck drain vent system 100 may include multiple vents that may be spatially distributed in various patterns and distances. For example, the deck drain vent system 100 may include four vents, with one vent placed at each corner of the deck drain vent system 100. The deck drain vent system 100 also may include multiple vents evenly distributed along the perimeter of the deck drain vent system 100 or, alternatively, vents may be spaced in a random or decorative pattern. While FIG. 1 depicts a single vent 120, it is contemplated that the deck drain vent system 100 may include multiple vents 120. The vents 120 may be spaced so that a minimum or maximum number of vents 120 are included within a certain square footage of panels. For example, the vents 120 may be spaced such that there are three vents 120 for every ten square feet of panel surface area. In addition, the total number of vents 120 spacing may be such that a minimum or maximum combined area in plan view for vent openings exists for a certain square footage of panels. For example, the vents 120 may be sized and spaced such that there may be a minimum of one square foot and a maximum of two square feet of vent openings per ten square feet of panel area.

While FIG. 1 depicts a deck drain vent system 100 attached to a house, it is contemplated that the deck drain vent system 100 may be used with free standing deck structures. For example, the deck drain vent system 100 may be installed under a gazebo. Furthermore, while FIG. 1 depicts multiple interlocking panels 115, it is contemplated that a single panel may be fabricated for locating under the deck 105.

Figure 2:
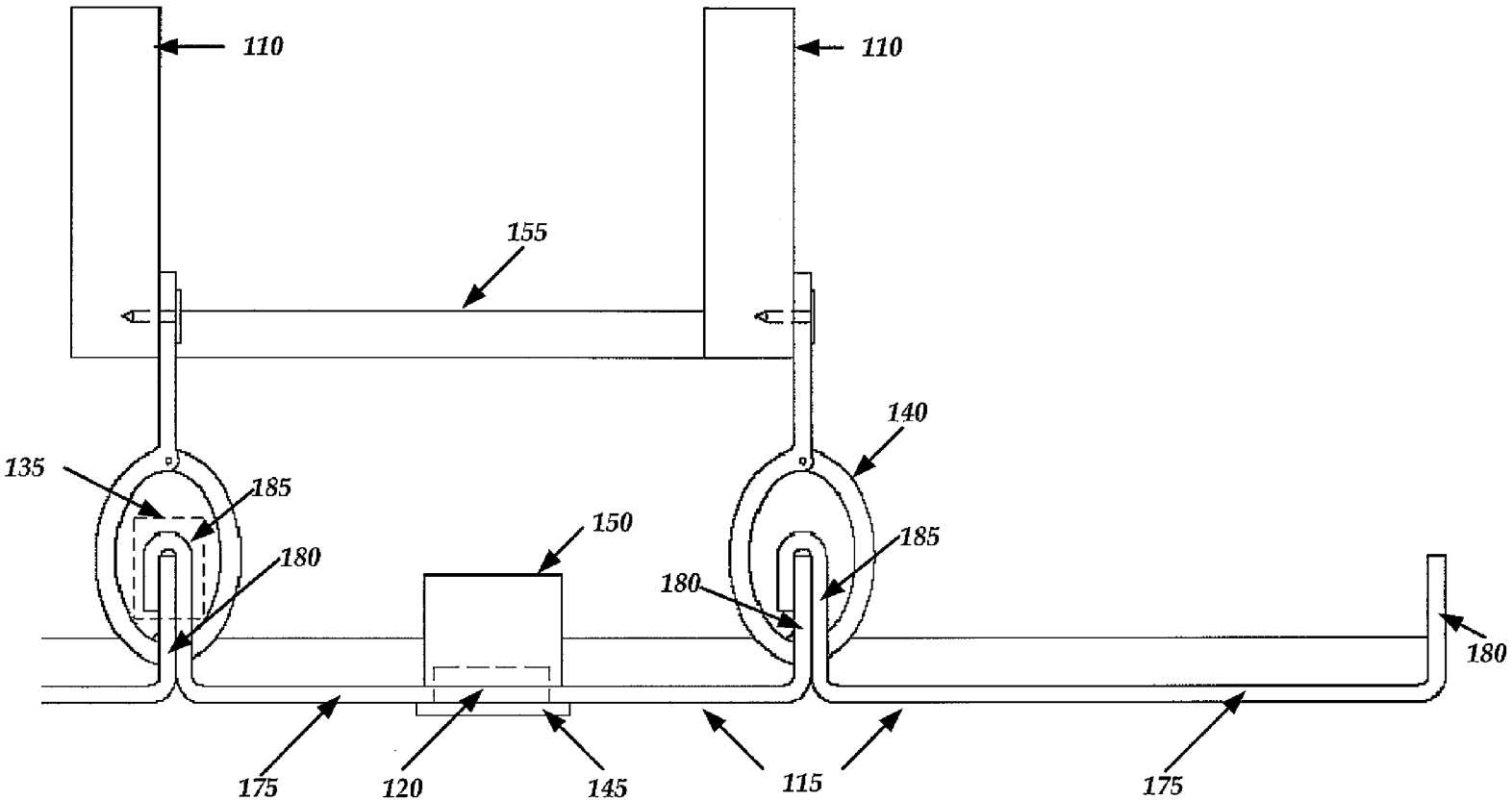
FIG. 2 depicts a detail of a portion of the deck drain vent system depicted in FIG. 1.

FIG. 2 depicts a detail of a portion of deck drain vent system 100 shown in FIG. 1. Panels 115 may include a standing seam 135. The standing seam 135 may be used to attach the panel 115 to the joist 110 via at least one support member 140. The panel 115 includes a first sidewall 180, a bottom wall 175, and second sidewall 185. As illustrated, the second sidewall 185 includes a u-shaped portion configured to surround the first sidewall 180 creating the standing seam 135. While FIG. 2 the depicts support member 140 as a mechanical clasp nailed to the joist 110, it is contemplated that the support member 140 may be attached to the joist 110 in other manners such as bolting, use of an adhesive, or a combination of attachment techniques. It is further contemplated that the support member 140 may be constructed in a manner that would require no secondary components to attach the support member 140 to the joist 110. For example, the support member 140 may be manufactured to include one or more protrusions that may be hammered directly into the joist 110. In addition, while FIG. 2 depicts the support member 140 attaching to the panel 115 via a mechanical clasp, it is contemplated that the support member 140 may attach to the panel 115 via other methods including but not limited to, welding, bolting, use of an adhesive, or a combination of attachment techniques. Furthermore, it is contemplated that the support member 140 may be manufactured from a variety of materials including but not limited to, plastics, metals, and ceramics and that the support member 140 may be a component of the panel 115. For example, the panel 115 may be constructed of a plastic and include one or more protrusions that may attach directly to the joist 110.

Figure 3:
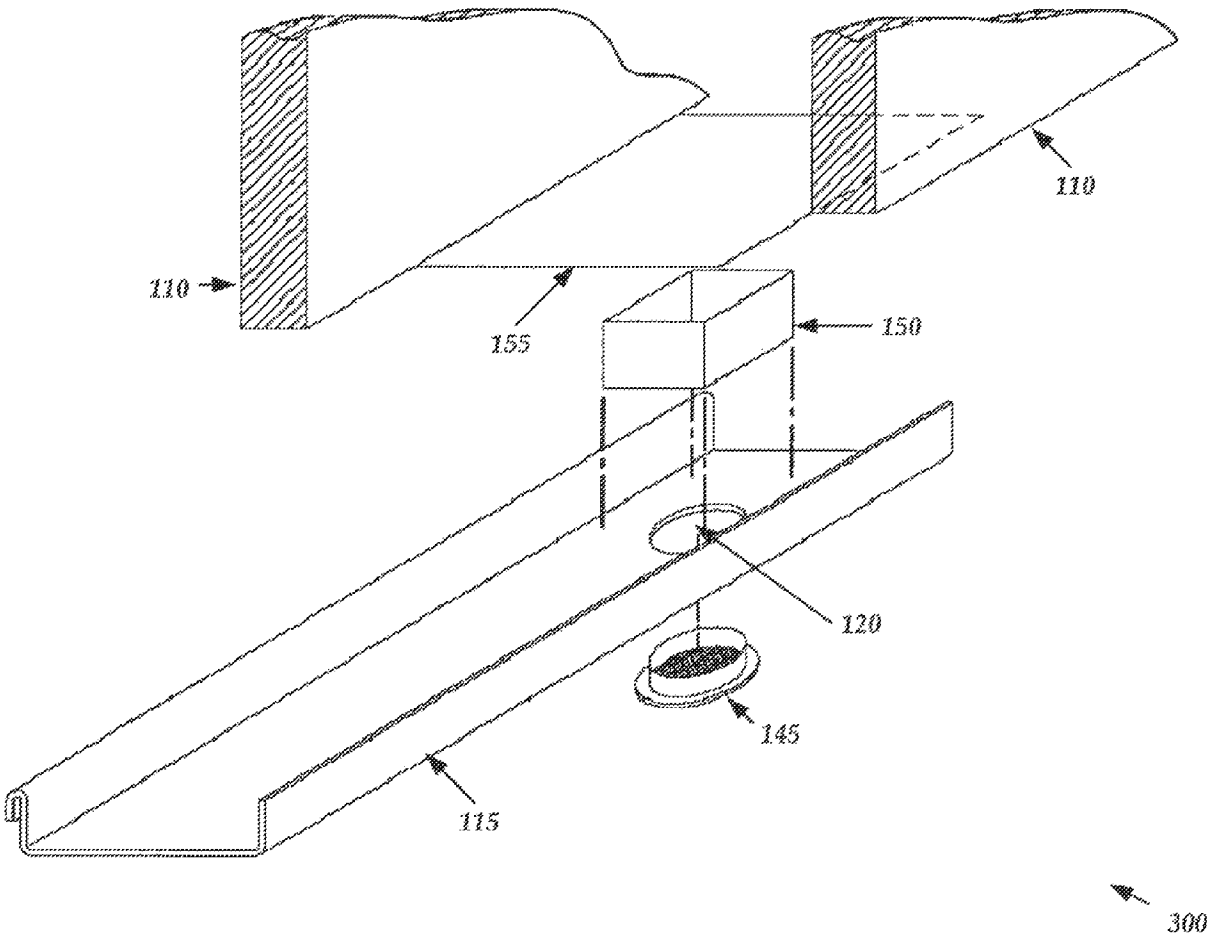
FIG. 3 depicts an exploded assembly of the detail depicted in FIG. 2.

FIG. 3 depicts an exploded assembly of the detail depicted in FIG. 2. The panel 115 includes a vent 120. The vent cover 145 may be attached to the panel 115. The shaft lock 150 may be attached to the panel 115 and the shroud 155 may be suspended above the vent 120. In addition, the shaft lock 150 may be attached to the joist 110. The shaft lock 150 does not necessarily need to be the same shape as the vent 120. In addition, the shroud 155 does not necessarily have to be the same shape as the vent 120 or the shaft lock 150.

Figure 5A:
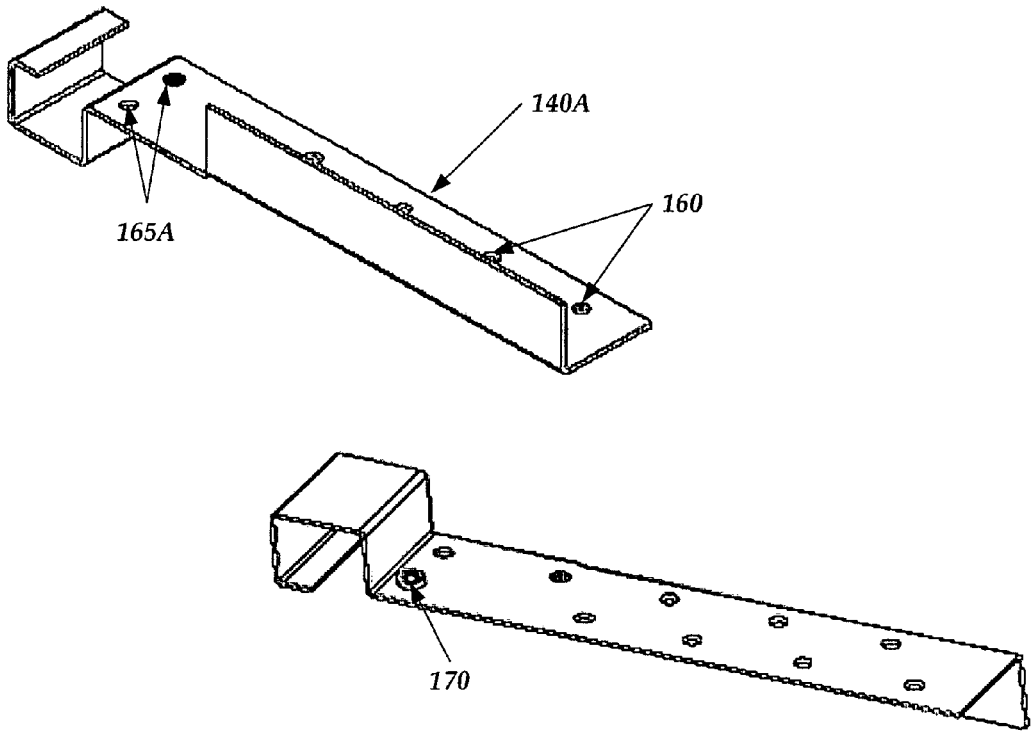
FIGS. 5A and 5B depict components of a support member.
Figure 5B:
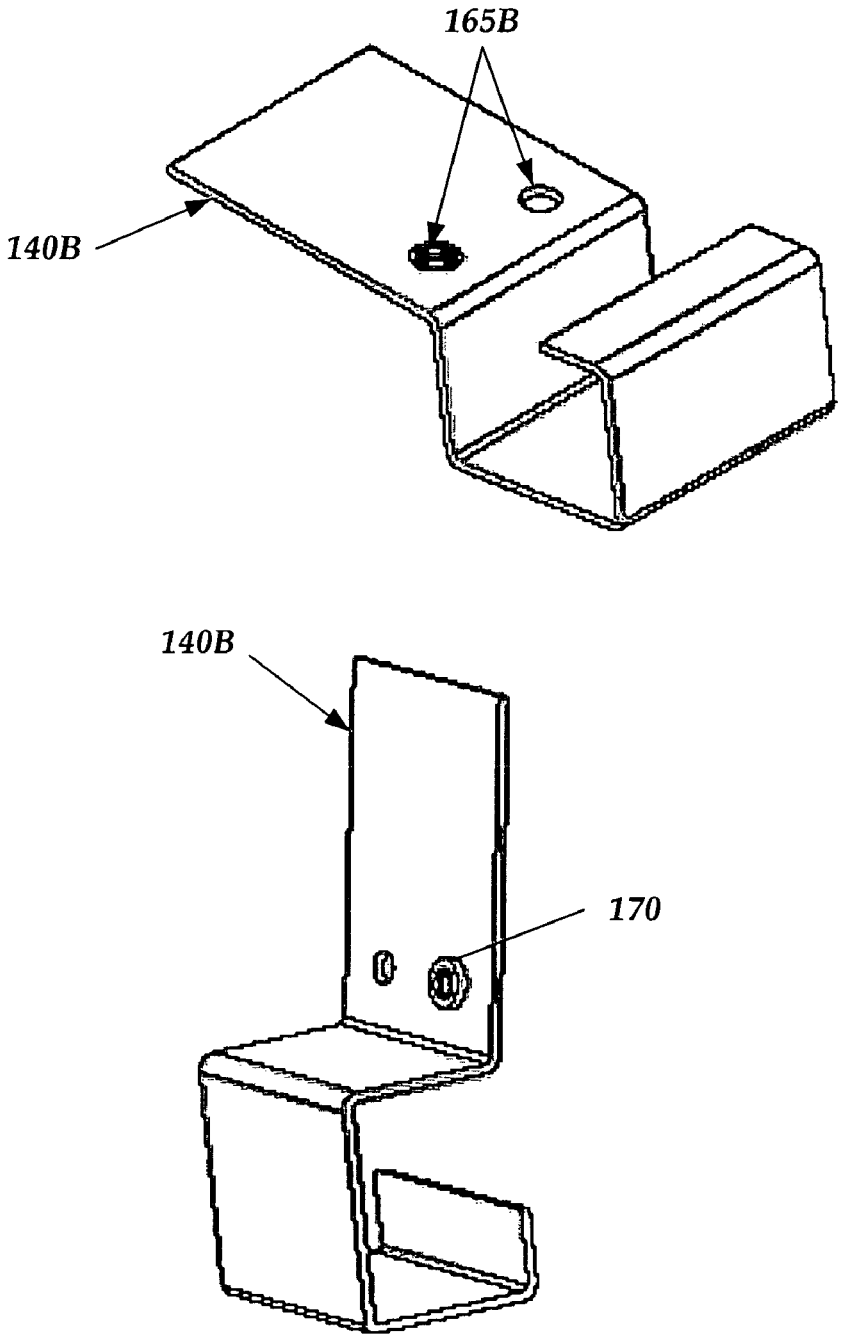

FIGS. 5A and 5B depict components of a support member 140A, 140B used in one embodiment of the present invention. Support member component 140A may contain various holes 160 to enable the support member to be secured to deck 105. Support member components 140A and 140B may be secured together via bolts or screws (not shown). Holes 165A and 165B may contain a threaded fitting 170 that may be press-fitted into holes 165A and 165B. While FIGS. 5A and 5B show the use of threaded fitting 170, it is contemplated using a nut instead. It is further contemplated that threaded fitting 170 may be omitted and either or both of support members 140A and 140B may be tapped or the bolts or screws used to fasten support members 140A and 140B together may be self-tapping and require no additional hardware.

Referring now to FIGS. 1 and 3, panel 115 also comprises at least one vent 120. Vent 120 may be comprised of penetrations in panel 115, perforations, or corrugations. The penetrations may be of various shapes in plan view including but not limited to circles, rectangles, or other polygonal shapes. It is further contemplated that vent 120 may be of various sizes. For example, vent 120 may comprise circular openings ranging in size from one square inch to twelve square inches.

As best shown in FIGS. 2 and 3, the vent 120 may also include a vent cover 145. The vent cover 145 may be configured to provide a decorative appearance, to keep small animals from entering the cavity 125, or to allow a person to access the cavity 125. Additionally, complementary mating surfaces of the vent cover 145 and the panel 115 may be bonded together with a sealant. In general, the vent cover 145 may be an "off-the-shelf" product distributed by vendors such as GRAINGER or MCMASTER-CARR. For example, a foundation vent distributed by GRAINGER stock number 4KY88 or a breather vent distributed by MCMASTER-CARR stock number 4471K11 may be used as the vent cover 145. In addition, the vent cover 145 may include a powered fan to facilitate air and gas communication between the cavity 125 and ambient. Furthermore, the vent cover 145 may be a screen material similar to that found on windows. The screen material may be secured to the panel via an adhesive or other attachment methods.

The deck drain vent system 100 may also include a shaft lock 150. The shaft lock 150 may be attached to the panel 115 or to the vent cover 145. The shaft lock 150 may be of varying heights. For example, the height of the shaft lock 150 may range from one-quarter of an inch to just below the lower surface of the surface 105. Generally, the height of the shaft lock 150 may range from one-quarter of an inch to twelve inches. The shaft lock 150 may be configured such that liquids and solids falling into the cavity 125 will flow around the shaft lock 150 and not through the vent 120 to the area below the deck 105. Fluid communication between the cavity 125 and the surrounding the environment is not substantially hindered as a result of the shaft lock.

The shaft lock 150 may be manufactured from various materials such as plastics, metals, or ceramics. Furthermore, the panel 115 may be manufactured such that the shaft lock 150 may be directly incorporated into the panel 115. For example, the panel 115 may include an extruded section that forms the shaft lock 150. In addition, the shaft lock 150 and the panel 115 may have complementary mating surfaces that may be sealed with a sealant, such as silicon, caulking, welded together, or soldered.

Still referring to FIGS. 2 and 3, the deck drain vent system 100 may also include a shroud 155. The shroud 155 may be configured such that liquids and solids which pass through the deck 105 do not fall directly into the vent 120 or the shaft lock 150. In addition, the shroud 155 may also include a slope so that liquids or solids may be diverted onto the panel 115. The shroud 155 may be attached to the deck drain vent system 100 in a various ways. For example, the shroud 155 may be attached to the joist 110, the panel 115, the shaft lock 150, suspended from the support member 140, or a combination of these and other techniques. The shroud 155 may have a surface area in plan view that equals or exceeds the area of the vent 120. In addition, the shroud 155 may be of various shapes. For example, the shroud 155 may have an area ranging from one square inch to several square feet and be rectangular or circular. The shroud 155 may be manufactured from various materials such as plastics, metals, or ceramics.

While FIGS. 1-3 depict various components of the deck drain vent system 100, it should be understood that certain components may be omitted in various embodiments without departing from the spirit and scope of the invention. For example, referring to FIG. 3, the shroud 155 may be omitted while incorporating the shaft lock 150 without departing from the scope of the invention. Similarly, the shaft lock 150 or the vent cover 145 may be omitted while incorporating the shroud 155 without departing from the scope of the invention.

Figure 4:
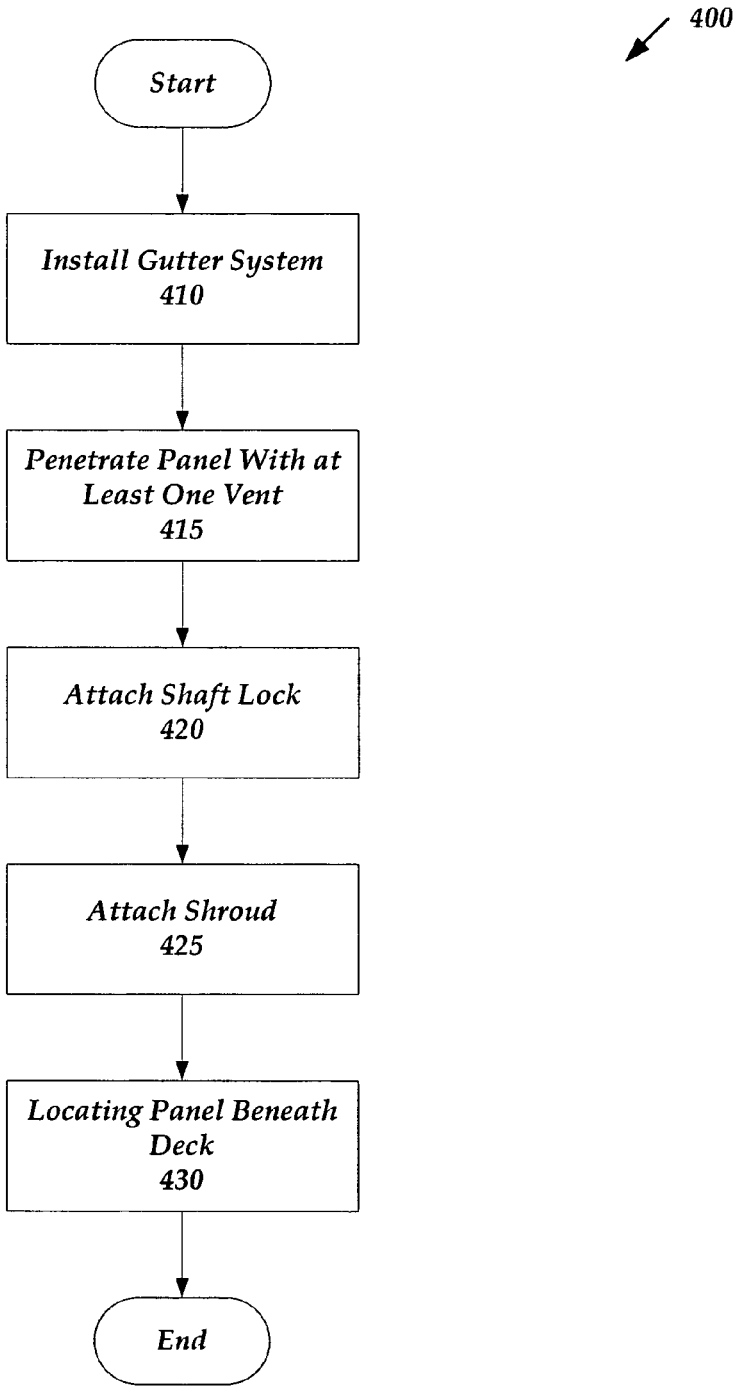
FIG. 4 depicts a flow chart outlining a method for providing a deck drain vent system.

FIG. 4 depicts a flow chart outlining a method 400 for providing a deck drain vent system. The method 400 begins by installing a gutter system 410. After the gutter system is installed, at least one vent 415 may penetrate the panels. Shaft locks may then be installed 420 as necessary. Next, shrouds may be attached 425 as desired. Last, at least one panel is located beneath a preexisting structure 430, such as a deck.

FIG. 4 outlines various stages for providing a the deck drain vent system 100. It is also contemplated that the various stages may be performed in a different order. For example, the panels 115 may be penetrated with vents 415 and the shaft lock 150 may be attached 420 before the panels are suspended beneath the deck 430. In addition, attaching shrouds 425 may be the first stage of construction and installing the gutter 410 may be the last stage. Furthermore, various stages may be omitted in various embodiments of the invention. For example, attaching the shrouds 425, attaching the shaft locks 420, and/or installing the gutter 410 may be omitted.

Reference has been made throughout this specification to "one embodiment," "an embodiment," or "embodiments" meaning that a particular described feature, structure, or characteristic is included in at least one embodiment of the present invention. Thus, usage of such phrases may refer to more than just one embodiment. Furthermore, the described features, structures, or characteristics may be combined in any suitable manner in one or more embodiments.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

The above specification, examples and data provide a complete description of the manufacture and use of the invention. Since many embodiments of the invention can be made without departing from the spirit and scope of the invention, the invention resides in the claims hereinafter appended.

We claim:

1. A ventilated deck drainage system comprising: a plurality of solid and substantially planar drainage panels, at least one of the plurality of drainage panels comprising a vent opening formed therethrough for allowing passage of gases between a first side of the drainage panel and a second side of the drainage panel; a shaft lock secured to the first side of the at least one the of plurality of drainage panels, the shaft lock comprising a wall surrounding the vent opening and an open end adjacent the vent opening, the shaft lock obstructing passage of liquids and solids into the vent opening and allowing the gases to pass into the vent opening; and a solid shroud disposed above the vent opening and the shaft lock in a stacked relation, the shroud obstructing flow of liquids and solids into the vent opening and allowing flow of the gases into the vent opening.

2. The ventilated deck drainage system of claim 1, further comprising a vent cover at the vent opening.

3. The ventilated deck drainage system of claim 1, wherein the shaft lock is attached to the drainage panel at an attachment location, and wherein the shaft lock and the drainage panel are sealed with a sealant at least at the attachment location.

4. The ventilated deck drainage system of claim 3, wherein the shaft lock and the drainage panel have complementary mating surfaces, and wherein the complementary mating surfaces are sealed with the sealant.

5. The ventilated deck drainage system of claim 1, wherein the shroud comprises a substantially planar solid structure, and wherein the shroud, the shaft lock, and the vent opening are arranged in a stacked relation.

6. The ventilated deck drainage system of claim 1, further comprising a clamping support member in contact with the at least two drainage panels.

7. The ventilated deck drainage system of claim 6, wherein the at least two drainage panels are configured to cooperatively form a standing seam, and wherein the clamping support member is in contact with the at least two drainage panels at least at the standing seam.

8. The ventilated deck drainage system of claim 1, further comprising a further vent opening formed in at least one of the plurality of drainage panels.

9. A ventilated deck drainage system comprising: a plurality of substantially solid planar drainage panels, at least two of the plurality of drainage panels comprising a first side, a second side, a first edge having a first shape, and a second edge having a second shape, and at least one of the at least two drainage panels having a vent opening formed through the at least one of the at least two drainage panels, the vent opening being configured to allow passage of gases between the first side and the second side, wherein the first edge and the second edge are configured to cooperatively form a standing seam; a vent cover located proximate to the vent opening, the vent cover being configured to obstruct passage of solids between the first side and the second side; a shaft lock secured to the first side of at least one of the at least two drainage panels, the shaft lock comprising a wall surrounding the vent opening, an open end adjacent the vent opening, and a further open end, wherein the shaft lock is located and configured to obstruct passage of liquids and solids into the vent opening and to allow passage of the gases into the vent opening and between the first side and the second side; and a solid shroud disposed above the further open end of the shaft lock and the vent opening in a stacked relation, the shroud being located and configured to obstruct passage of liquids and solids into the further open end of the shaft lock and the vent opening and to allow the gases to pass into the vent opening.

10. The ventilated deck drainage system of claim 9, further comprising a deck joist disposed above the drainage panel, wherein the shroud is secured to the deck joist.

11. The ventilated deck drainage system of claim 9, further comprising a fan for moving the gases.

12. The ventilated deck drainage system of claim 9, wherein the shaft lock is secured to the drainage panel at a securing location, and wherein the shaft lock and the drainage panel are sealed with a sealant at least at the securing location.

13. The ventilated deck drainage system of claim 12, wherein the shaft lock and the drainage panel have complementary mating surfaces, and wherein the complementary mating surfaces are sealed with the sealant at least at the securing location.

14. A ventilated deck drainage system comprising:

a plurality of substantially solid planar drainage panels, at least two of the plurality of drainage panels comprising a first side, a second side, a first edge having a first shape, and a second edge having a second shape, and at least one of the at least two drainage panels having a vent opening formed through the at least one of the at least two drainage panels, the vent opening being configured to allow passage of gases between the first side and the second side;

a vent cover located proximate to the vent opening, the vent cover being configured to obstruct passage of solids between the first side and the second side;

a shaft lock secured to the first side of at least one of the at least two drainage panels, the shaft lock comprising a wall surrounding the vent opening, an open end adjacent the vent opening, and a further open end, wherein the shaft lock is located and configured to obstruct passage of liquids and solids into the vent opening and to allow passage of the gases into the vent opening and between the first side and the second side; and a shroud disposed above the further open end of the shaft lock and the vent opening in a stacked relation, the shroud being located and configured to obstruct passage of liquids and solids into the further open end of the shaft lock and the vent opening and to allow the gases to pass into the vent opening, wherein the shaft lock is secured to the first side of the drainage panel at a securing location, wherein the shaft lock and the drainage panel are sealed with a sealant at least at the securing location, wherein the shaft lock and the drainage panel have complementary mating surfaces, and wherein the complementary mating surfaces are sealed with the sealant at least at the securing location, and wherein the first edge and the second edge are configured to cooperatively form a standing seam.

15. The ventilated deck drainage system of claim 14, further comprising a clamping support member in contact with at least two drainage panels.

16. The ventilated deck drainage system of claim 15, wherein the clamping support member is in contact with the at least two drainage panels at least at the standing seam cooperatively formed by the first edge and the second edge.

* * * * *

UNITED STATES PATENT AND TRADEMARK OFFICE

CERTIFICATE OF CORRECTION

PATENT NO. : 8,082,712 B1
APPLICATION NO. : 11/604479
DATED : December 27, 2011
INVENTOR(S) : Butler et al.

It is certified that error appears in the above-identified patent and that said Letters Patent is hereby corrected as shown below:

At Column 2, lines 36-37, please replace "single vent 120 proximate the structure" with --single vent 120 proximate to the structure--.

In claim 1, line 7, please replace "one the of plurality" with --one of the plurality--.

In claim 1, line 9, please replace "end adjacent the" with --end adjacent to the--.

In claim 14, lines 16-17, please replace "end adjacent the" with --end adjacent to the--.

Signed and Sealed this
Twentieth Day of March, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,082,712 B1
APPLICATION NO. : 11/604479
DATED : December 27, 2011
INVENTOR(S) : Butler et al.

It is certified that error appears in the above-identified patent and that said Letters Patent is hereby corrected as shown below:

At Column 2, lines 36-37, please replace "single vent 120 proximate the structure" with --single vent 120 proximate to the structure--.

Column 5, line 48 (claim 1, line 7) please replace "one the of plurality" with --one of the plurality--.

Column 5, line 50 (claim 1, line 9) please replace "end adjacent the" with --end adjacent to the--.

Column 7, lines 3-4 (claim 14, lines 16-17) please replace "end adjacent the" with --end adjacent to the--.

This certificate supersedes the Certificate of Correction issued March 20, 2012.

Signed and Sealed this
Tenth Day of April, 2012

David J. Kappos

David J. Kappos
*Director of the United States Patent and Trademark Office*